US012735864B2

(12) United States Patent
Miki

(10) Patent No.: US 12,735,864 B2
(45) Date of Patent: Sep. 15, 2026

(54) WORK MACHINE

(71) Applicant: Yanmar Holdings Co., Ltd., Osaka (JP)

(72) Inventor: Takahiro Miki, Fukuoka (JP)

(73) Assignee: Yanmar Holdings Co., Ltd., Osaka (JP)

( * ) Notice: Subject to any disclaimer, the term of this patent is extended or adjusted under 35 U.S.C. 154(b) by 513 days.

(21) Appl. No.: 18/228,698

(22) Filed: Aug. 1, 2023

(65) Prior Publication Data

US 2024/0044105 A1 Feb. 8, 2024

(30) Foreign Application Priority Data

Aug. 3, 2022 (JP) ..... 2022-123950

(51) Int. Cl.
*E02F 9/08* (2006.01)
*E02F 9/16* (2006.01)

(52) U.S. Cl.
CPC ..... *E02F 9/0891* (2013.01); *E02F 9/0808* (2013.01); *E02F 9/0866* (2013.01); *E02F 9/0883* (2013.01); *E02F 9/16* (2013.01)

(58) Field of Classification Search
CPC ..... E02F 9/0891; E02F 9/0808; E02F 9/0866; E02F 9/0883; E02F 9/16
See application file for complete search history.

(56) References Cited

U.S. PATENT DOCUMENTS 7,134,519 B2 * 11/2006 Imashige ..... E02F 9/0891 180/69.24
10,161,107 B2 * 12/2018 Namai ..... E02F 9/0833
11,313,101 B2 * 4/2022 Umizaki ..... E02F 9/0891

FOREIGN PATENT DOCUMENTS

DE 102009050189 A 4/2011
JP 2005155070 A * 6/2005
JP 3790016 B2 * 6/2006
JP 2008279930 A 11/2008
JP 2020143436 A * 9/2020

* cited by examiner

*Primary Examiner* — James A Shriver, II
(74) *Attorney, Agent, or Firm* — Chris Mizumoto

(57) ABSTRACT

An excavation work machine, in the support structure and opening/closing structure of an upper face cover which covers an upper side of a lateral-part engine chamber on the right side of a swing frame, and the support structure and opening/closing structure of a right exterior cover which covers the right side of the lateral-part engine chamber, includes a first frame part that is provided in the front-rear direction of the swing frame, and a second frame part that is provided perpendicular to the first frame part and that is, at a base end thereof, connected to the first frame part and, at another end thereof, connected to the right exterior cover.

18 Claims, 15 Drawing Sheets

WORK MACHINE

CROSS-REFERENCE

This application claims foreign priority of JP2022-123950 filed Aug. 3, 2022, the disclosures of which are hereby incorporated by reference in their entirety.

TECHNICAL FIELD

The present invention relates to a work machine, and to the support structure and opening/closing structure of an exterior cover that covers an engine chamber where a prime mover and devices are placed.

BACKGROUND ART

Conventionally, in a work machine, an engine chamber that receives a prime mover is covered with an exterior cover. In the engine chamber, there are placed tanks, a heat exchanger that cools a fluid such as engine cool water, and a device such as battery, other than the prime mover, and the above tanks and devices require regular maintenance. Due to this, the exterior cover is opened as needed thereby to allow a maintenance engineer to perform the maintenance.

Patent document 1 discloses an example of a work machine which is provided, to the left of the position for attaching a front work machine, with a cabin where a drive seat is placed and is provided, to the right, with an engine chamber; the work machine is provided with an opening/closing cover integrally formed with a front face part, an upper face part and a right face part which respectively cover the front, upper and right sides of the engine chamber. The above opening/closing cover is so configured as to swing in an opening/closing manner with a left side edge part of the upper face part as a pivot point.

PRIOR ART DOCUMENT

Patent Document

Patent Document 1: Japanese Unexamined Patent Application Publication No. 2008-279930

SUMMARY OF INVENTION

Technical Problem

In the opening/closing cover of the work machine disclosed in Patent Document 1, opening the opening/closing cover exposes the front, upper and right sides of the engine chamber to the outside. Meanwhile, the timing of maintaining the devices placed in the engine chamber varies depending on the respective uses and specifications of the devices. For example, when the frequency of battery replacement is low compared to the frequency of fueling of the fuel tank and only fueling of the fuel tank is to be performed, only a face part covering the fuel tank fueling port needs to be opened and all the front, upper and right face parts of the engine chamber do not need to be in the open state. Opening the opening/closing cover allows a foreign matter such as water, an insect, debris to enter the engine chamber, shortening the life of the devices, as the case may be. Further, as in Patent Document 1, the opening/closing cover that integrates the face parts covering the three directions of the engine chamber is heavy and places a heavy burden on the maintenance engineer in opening and closing the opening/closing cover, which is a problem.

The present invention has been made in view of the above problem; it is an object of the present invention to provide a work machine with improved workability during maintenance.

Solution to Problem

A work machine according to the present invention includes: a vehicle body frame; an engine chamber that is provided on the vehicle body frame and that receives a prime mover and a device; and a plurality of exterior covers that covers the engine chamber, wherein the work machine includes: a first frame part that is provided along a front-back direction of the vehicle body frame in plan view, and a second frame part that is, at a base end thereof, connected to the first frame part and, at another end thereof, connected to a lateral face cover which is of the exterior covers and which covers a lateral face of the engine chamber.

The work machine according to another mode of the present invention, wherein the second frame part is rotatably supported via a first hinge part to the first frame part.

The work machine according to another mode of the present invention, wherein an upper face cover which is of the plurality of exterior covers and which covers an upper face of the engine chamber is rotatably supported via a second hinge part to the first frame part.

The work machine according to another mode of the present invention, includes: a first hinge part having a first pivot shaft by which a base end of the second frame part is pivotally supported, and a second hinge part having: a cover attaching part that connects the upper face cover, and a second pivot shaft by which the cover attaching part is pivotally supported.

The work machine according to another mode of the present invention, wherein the first pivot shaft is provided in the first frame part, and the second pivot shaft is provided on a base end side of the second frame part.

The work machine according to another mode of the present invention, wherein the first pivot shaft and the second pivot shaft are provided in the first frame part.

The work machine according to another mode of the present invention, wherein the first pivot shaft and the second pivot shaft are provided on a same axial line.

The work machine according to another mode of the present invention, wherein the second frame part has a first hold part that holds a rotary angle of the second frame part at a given angle.

The work machine according to another mode of the present invention, wherein the second frame part has a second hold part that holds the rotary angle of the upper face cover at a given angle.

The work machine according to another mode of the present invention, wherein the second frame part has a bias part that biases a rotation of the second frame part.

The work machine according to another mode of the present invention, wherein the second frame part has a first link part and a second link part which are so placed on the first frame part as to be spaced apart from each other, and each of the first link part and the second link part connects the first frame part with the lateral face cover.

The work machine according to another mode of the present invention, wherein the first frame part is connected via a pillar to the vehicle body frame.

The work machine according to another mode of the present invention, wherein the pillar includes a first pillar and a second pillar, the first pillar has a linear shape and supports the first frame part from below, and the second pillar has a bent shape and supports the first frame part from side.

The work machine according to another mode of the present invention, wherein between the first pillar and the second pillar, a partition part that partitions a space in the engine chamber is provided.

The work machine according to another mode of the present invention, wherein the first frame part has one end that is formed by bending and the one end is connected to the vehicle body frame, and another end that is connected via the first pillar to the vehicle body frame.

The work machine according to another mode of the present invention, wherein a storage tank capable of storing a liquid is placed in the engine chamber, and the first frame part has an attaching part to which the storage tank is attached.

A work machine according to another mode of the present invention includes: a swing frame; a cabin placed on a left side on the swing frame; and an engine chamber placed on a right side on the swing frame, wherein the work machine includes: a right exterior cover that covers a right lateral face of the engine chamber, and an upper face cover that covers an upper part of the engine chamber, the upper face cover, above the right exterior cover, is so provided as to be rotatable with a left end edge side of the upper face cover as a pivot point, and the right exterior cover is so provided as to be rotatable integrally with the upper face cover with the left end edge side of the upper face cover as the pivot point.

The work machine according to another mode of the present invention, wherein the engine chamber has a first frame part provided on the cabin side along a front-back direction and a second frame part that has a base end rotatably supported to the first frame part, and another end of the second frame part is attached to an inner wall of the right exterior cover.

The work machine according to another mode of the present invention, wherein the upper face cover is rotatably provided at an upper part of the second frame part.

Advantageous Effects of Invention

The present invention makes it possible to improve, in the support structure and opening/closing structure of an exterior cover that covers an engine chamber in which a prime mover and device are placed, workability during maintenance.

DESCRIPTION OF EMBODIMENTS

The present invention, in the configuration of an exterior cover so provided to an engine chamber as to open and close, aims to devise the support structure and opening/closing structure of the exterior cover thereby to improve workability during maintenance. Descriptions will hereinafter be made on an embodiment of the present invention with reference to drawings.

In the embodiment of the present invention, the description is to be made on an excavation work machine (shovel), which is a turn work vehicle, as an example of a work machine according to the present invention. However, the work machine according to the present invention is not limited to the excavation work machine, and is widely applicable to other types of work machines such as a bulldozer, a crane work machine, a compact truck loader, a skid steer loader, and a wheel loader.

Figure 1:
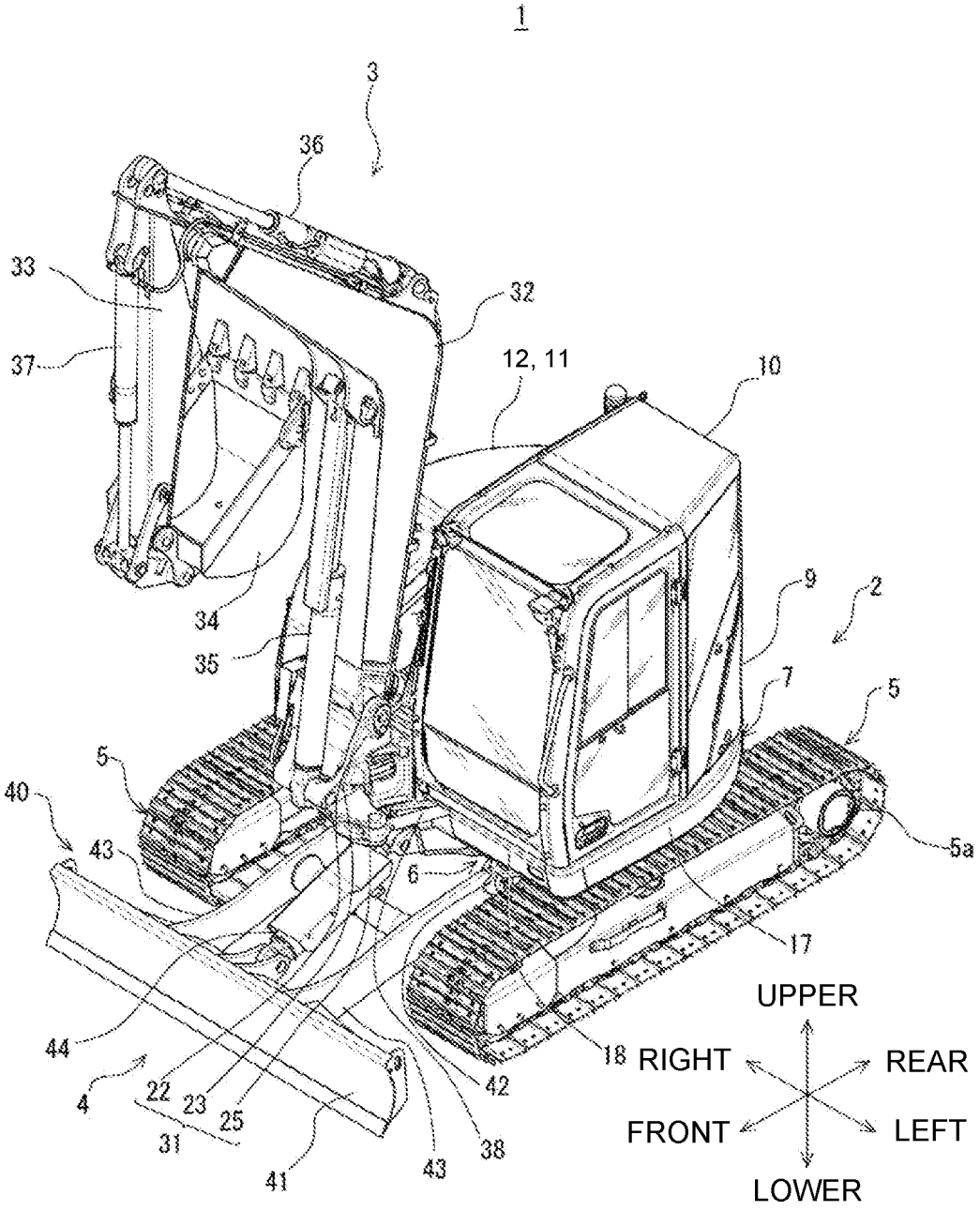
FIG. 1 is a perspective view of an excavation work machine according to an embodiment of the present invention.
Figure 2:
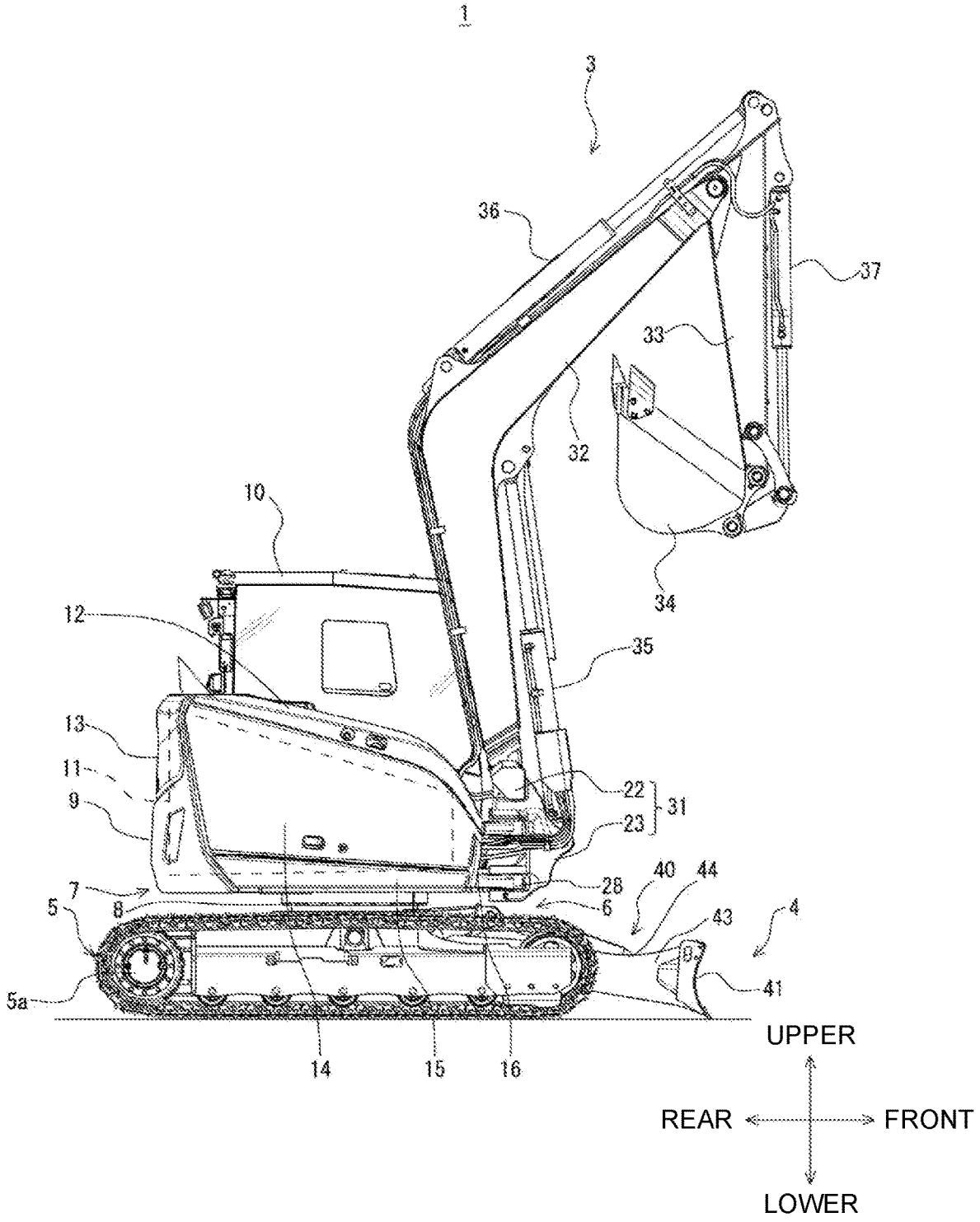
FIG. 2 is a right side view of the excavation work machine according to the embodiment of the present invention.

Descriptions are to be made on an overall configuration of an excavation work machine 1 according to the present embodiment, with reference to FIG. 1 and FIG. 2. Unless a directional view is particularly specified, the terms "front side", "rear side", "right and left sides", "plan side" or "upper side", "bottom side" or "lower side" are used below with reference to positions of an operator seated on a drive seat of the excavation work machine 1.

As shown in FIGS. 1 and 2, the excavation work machine 1 includes a travel vehicle body (machine body) 2 that can be self-propelled, and an excavation device 3 and a soil removal device 4 each of which is a work machine attached to the travel vehicle body 2.

The travel vehicle body 2 has a pair of right and left crawler-type travel parts 5, 5 and a machine body frame 6 as a base interposed between the right and left travel parts 5, 5.

The travel part 5 has a configuration in which a crawler is wound around a sprocket, an idler, and a plurality of rollers that are supported to the machine body frame 6. The travel part 5, at a rear end part thereof, has a drive sprocket 5*a* as a drive wheel.

The soil removal device 4 is attached to a front side of the machine body frame 6. The soil removal device 4 includes a support frame 40, and a blade 41 which is a soil removal plate supported to the support frame 40. The soil removal device 4, including the above configurations, is configured to be substantially bilaterally symmetrical as a whole.

The support frame 40 is so supported to the travel vehicle body 2 as to be rotatable up and down, and includes, between the right and left travel parts 5, 5, right and left arms 43 extending in a front-rear direction. With the right-left direction as the rotary axis direction, the right and left arms 43 are supported at base end parts thereof to a support bracket 42 provided at a front part of the machine body frame 6. The support frame 40 is turned up and down by extending and contracting of a blade cylinder 44. That is, extending and contracting of a blade cylinder 44 causes the blade 41 to turn up and down via the support frame 40.

The travel vehicle body 2 has a swing frame 7 which is so installed as to turn relative to the travel part 5. The swing frame 7 is connected via a turn bearing 8 to the machine body frame 6, and is so provided as to be turnable, by drive of a turn motor (not shown), in any of the right-left direction about an axis in an up-down direction relative to the machine body frame 6.

The excavation device 3 is attached to a front side of the swing frame 7. The excavation device 3 has a boom 32 that is included in a base part side of the excavation device 3, an arm 33 that is connected to a tip side of the boom 32, and a bucket 34 that is attached to a tip part of the arm 33. Further, the excavation device 3 has a boom cylinder 35 that rotates the boom 32, an arm cylinder 36 that rotates the arm 33, and a bucket cylinder 37 that rotates the bucket 34.

A base end part of the boom 32 is supported to a boom support bracket 31. Via a swing axis with the up-down direction as a rotary axis direction, the boom support bracket 31 is supported to a bracket attaching part 28 protrusively provided at the swing frame 7.

The boom support bracket 31 has a boom support part 22 by which the base end of the boom 32 is rotatably supported with the right-left direction as the rotary axis direction, a boom cylinder support part 23 that supports a lower end of the boom cylinder 35, and a swing cylinder connection part 25 that connects a tip of a rod of a swing cylinder 38. An action of the swing cylinder 38 turns the boom support bracket 31 about the swing axis, thereby turning the excavation device 3 to the right and left.

The boom cylinder 35, the arm cylinder 36, the bucket cylinder 37, and the swing cylinder 38 are each a hydraulic cylinder actuated by a pressure oil discharged by a hydraulic pump (not shown). Further, in the excavation device 3, the bucket 34 is detachably attached as a work attachment, and, according to contents of work, another attachment such as a gripper (fork) or a crusher (breaker) is attached instead of the bucket 34.

On the swing frame 7, there are provided a cabin 10 that receives a drive part where the operator drives and operates the travel part 5 and the work machine, and an engine chamber 11 that receives an engine 53, a battery 54, a fuel tank 51 for the engine and a hydraulic oil tank 52 for the hydraulic cylinder.

Above the engine chamber 11 on the right side of the swing frame 7 is covered with an upper face cover 12. Behind the engine chamber 11 is covered with a rear cover 13 and with a counterweight 9 that is for balancing the weight with the excavation device 3. The right side face of the engine chamber 11 of the swing frame 7 is covered with a right exterior cover 14. The right side lower part of the engine chamber 11 is covered with a right lower exterior cover 15. Front of the engine chamber 11 is covered with a right front cover 16. The left side lower part of the cabin 10 is covered with a left lower exterior cover 17. The front side lower part of the cabin 10 is covered with a left front cover 18.

A drive seat is provided in the cabin 10; around the drive seat, there are provided a travel lever for causing the travel part 5 to travel, plural operation pedals, work operation levers, and operation panel parts, etc. for swinging the swing frame 7 and operating the work machine.

In the excavation work machine 1 provided with the above configuration, the operator who is getting on the cabin 10 properly operates the travel lever and/or the work operation lever, etc., thereby to perform a desired action or work. For example, operating the travel lever causes the travel part 5 to perform the straight forward-backward travel or the right-left swing travel, and operating the work operation lever causes the excavation device 3 to perform the excavation work, or causes the soil removal device 4 to perform the soil removal work and/or leveling work.

Figure 3:
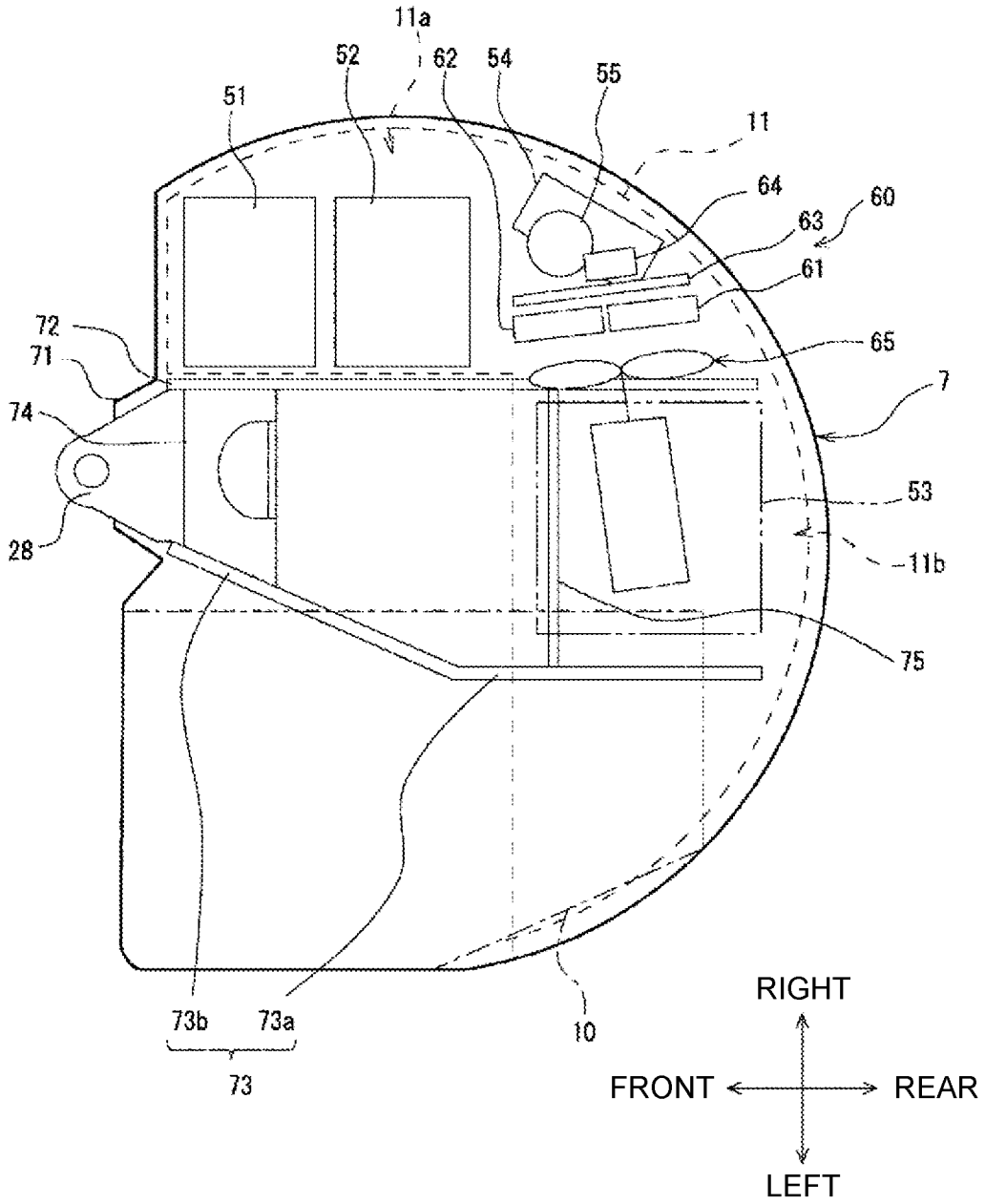
FIG. 3 is a plan overview illustrating a placement of a configuration of a swing frame 7 in the excavation work machine according to the embodiment of the present invention.

The placement of the configurations on the swing frame 7 in the excavation work machine 1 according to the present embodiment is to be described with reference to FIG. 3. Further, in the plan view shown in FIG. 3, the main configuration placed on the swing frame 7 is shown in a simplified form.

The swing frame 7 has a substrate 71, and a right longitudinal rib 72, a left longitudinal rib 73, a front transverse rib 74 and a rear transverse rib 75 which ribs are reinforcement members fixed to the substrate 71. Each of the ribs includes a thick steel plate having a given thickness, and is erected on the substrate 71 with the plate thickness direction as the horizontal direction. The bracket attaching part 28 is fixed to the front end of the substrate 71.

The substrate 71 is so shaped that, in plan view, the right and left end parts and the rear end part are formed in a substantial arc. Further, the term "substantially arc shape" here shall include not only a simple arc but also a shape that is a series of plural arcs with different center angles and a shape that includes a partial straight line.

In the position on the right side of the substrate 71, the right longitudinal rib 72 is linearly provided across the front and back. That is, the right longitudinal rib 72, in plan view, extends from the right rear end of the bracket attaching part 28 in the front-back direction. The right longitudinal rib 72 is so formed that the front part is higher relative to the rear part, and the middle between the rear part and the front part is gradually lower in height toward the rear.

The left longitudinal rib 73, in the position on the left side of the substrate 71, has a rear left longitudinal rib 73*a* provided parallel to the right longitudinal rib 72 and a front left longitudinal rib 73*b* so inclinedly provided that the front end is closer to the right. The front left longitudinal rib 73*b*, in plan view, extends rearward from the left rear end of the bracket attaching part 28 at an oblique angle to the left, and the rear end of the front left longitudinal rib 73*b* is connected to the front end of the rear left longitudinal rib 73*a*.

The front transverse rib 74 has such a configuration that a plate body is bent at an angle of substantially 90 degrees in side view, with the lower end thereof fixed to the substrate 71, and the front-facing end part in contact with the rear end of the bracket attaching part 28. Further, the front transverse rib 74 has the left end fixed to the lateral face of the front left longitudinal rib 73*b* and the right end fixed to the lateral face of the right longitudinal rib 72, respectively.

The rear transverse rib 75 is provided in a position on the rear side of the substrate 71, with the left end fixed to the lateral face of the rear left longitudinal rib 73*a*, and the right end fixed to the lateral face of the right longitudinal rib 72, respectively.

The engine chamber 11, from the right side of the cabin 10 to the rear, is provided on the swing frame 7. Below the drive seat on the rear side of the cabin 10 placed on the left side forward on the swing frame 7 is also part of the engine chamber 11. Further, in the left-right direction of the swing frame 7, there is provided a space between the cabin 10 and the engine chamber 11 to allow the front-back movement of the boom 32 of the excavation device 3 attached to the bracket attaching part 28.

The engine chamber 11, with the substrate 71 of the swing frame 7 as a floor, is formed as a space where the right side is covered with the right exterior cover 14, the upper part is covered with the upper face cover 12, and the rear part is covered with the rear cover 13. Of the engine chamber 11, in a lateral-part engine chamber 11*a* on the right side of the swing frame 7, there are placed the fuel tank 51, the hydraulic oil tank 52, the battery 54, and the heat exchange unit 60. The engine 53 and a cool fan 66 are placed in a rear part engine chamber 11*b* on the rear side of the swing frame 7.

The engine 53 is a diesel engine that receives a fuel supplied from the fuel tank 51, and is transversely placed in the rear part engine chamber 11*b*. A combustion gas generated in the combustion chamber of the engine 53 is discharged via an exhaust device and a muffler out of the engine chamber 11.

The heat exchange unit 60 and the cool fan 66 are placed on the right side of the engine 53 and behind the lateral-part engine chamber 11*a*. The engine 53, the cool fan 66, and the heat exchange unit 60 are placed on the swing frame 7, in that order, from the inside toward the right side of the engine chamber 11.

That is, the heat exchange unit 60 is placed on an air suction side of the cool fan 66, and the engine 53 is placed on an air discharge side of the cool fan 66.

The battery 54, which stores power to be supplied to an electric component installed on the excavation work machine 1, is placed to the right of the heat exchange unit 60 of the lateral-part engine chamber 11*a*, and is fixed to the substrate 71.

Further, above the battery 54 and on the right side of the heat exchange unit 60, there is placed an air cleaner 55 for cleaning the air supplied to the engine 53. The air cleaner 55 and the engine 53 are connected via an air introduction piping (not shown).

The heat exchange unit 60 includes a radiator 61, an oil cooler 62, and a capacitor 63.

The radiator 61 is a heat exchanger for cooling the engine cool water, and includes a distribution path through which the cool water is distributed and a heat sink part. The radiator 61 is connected to a reserve tank 64 that tanks the cool water which temporarily overflows from the distribution path in the radiator 61. The oil cooler 62 is a heat exchanger for cooling the hydraulic oil that actuates the hydraulic cylinder, etc., and includes a distribution path through which the hydraulic oil is distributed and a heat sink part. The oil cooler 62, by the heat sink part, dissipates heat of the return oil from each hydraulic cylinder thereby to cool the hydraulic oil returning to the hydraulic oil tank 52. Further, the capacitor 63 is a heat exchanger for cooling a high-pressure refrigerant of an air conditioner (not shown) that conditions air in the cabin 10, and is connected to a compressor (not shown).

The radiator 61 and the oil cooler 62 are placed in a row in the substantially front-rear direction. The capacitor 63 is placed on the right side of the radiator 61 and oil cooler 62, and is placed in the position opposite the radiator 61 and the oil cooler 62.

The cool fan 66 is placed facing the heat exchange unit 60, and supplies cool air to the heat exchangers included in the heat exchange unit 60. The cool fan 66 is an axial flow-type fan; connecting to one end side of a crankshaft of the engine 53, for example, the cool fan 66 rotates together with rotation of the crankshaft.

The right exterior cover 14 has plural air vents (not shown); rotating the cool fan 66 takes the cooling outside air from the air vents into the engine chamber 11. That is, the rotation of the cool fan 66 causes the air to flow from right to left in the engine chamber 11.

Figure 4:
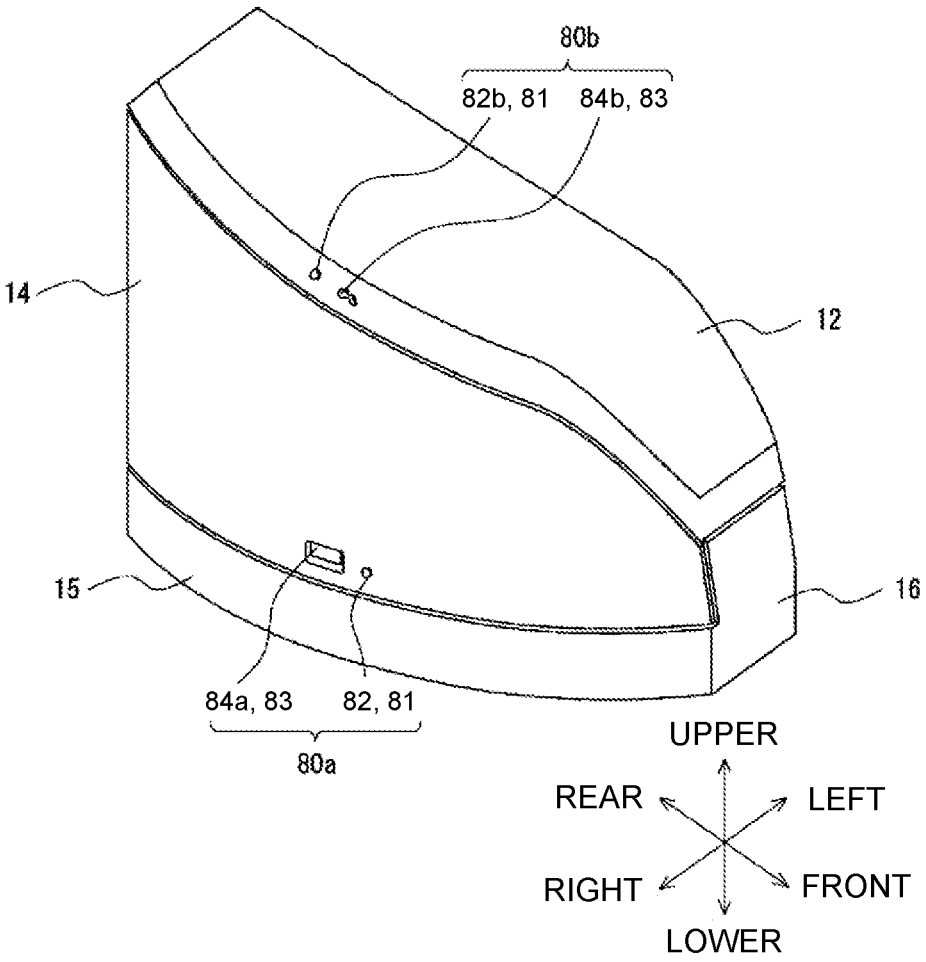
FIG. 4 is a perspective view of the lateral-part engine chamber part of the swing frame 7 in the excavation work machine according to the embodiment of the present invention.
Figure 5:
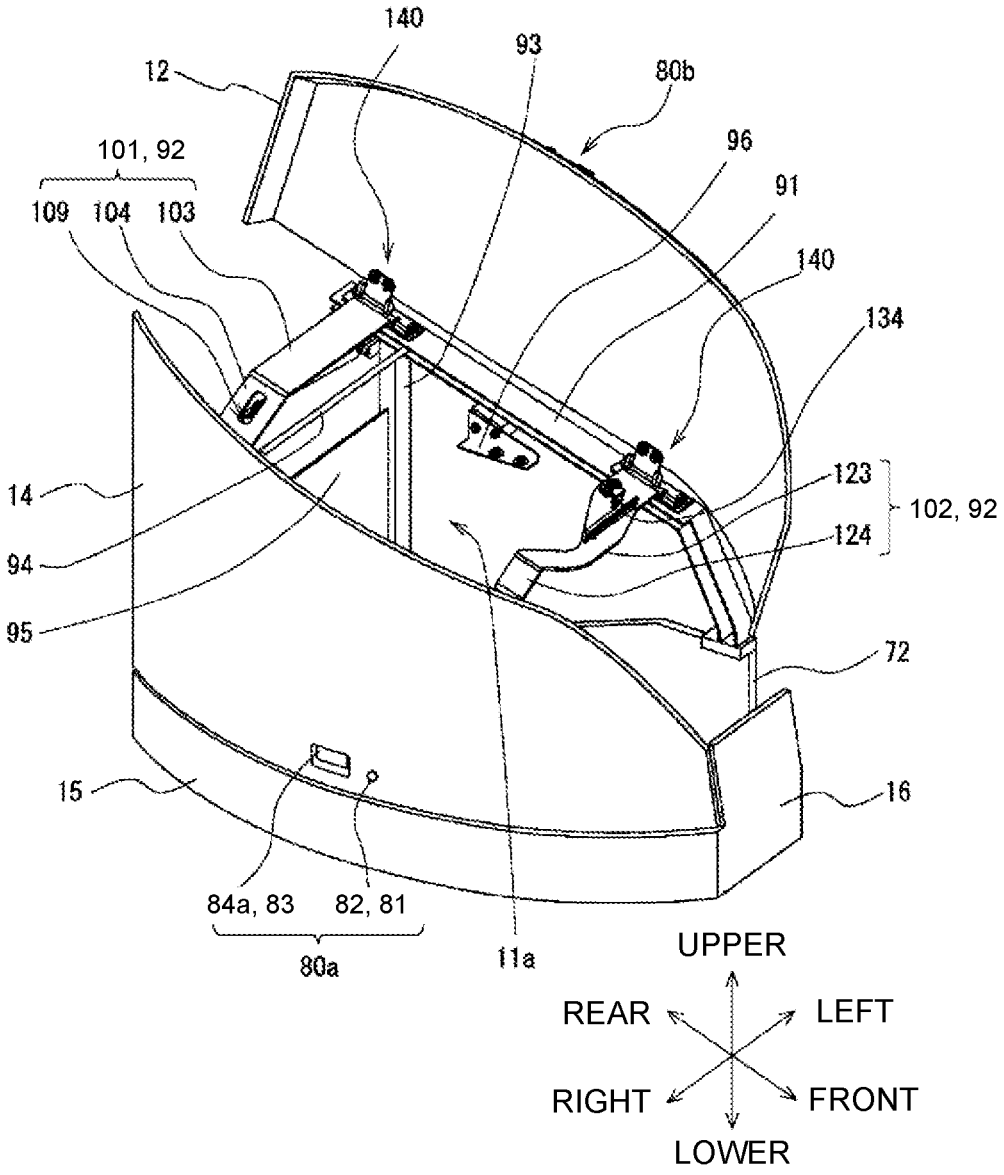
FIG. 5 is a perspective view of a state of opening an upper face cover that covers the lateral-part engine chamber.
Figure 6:
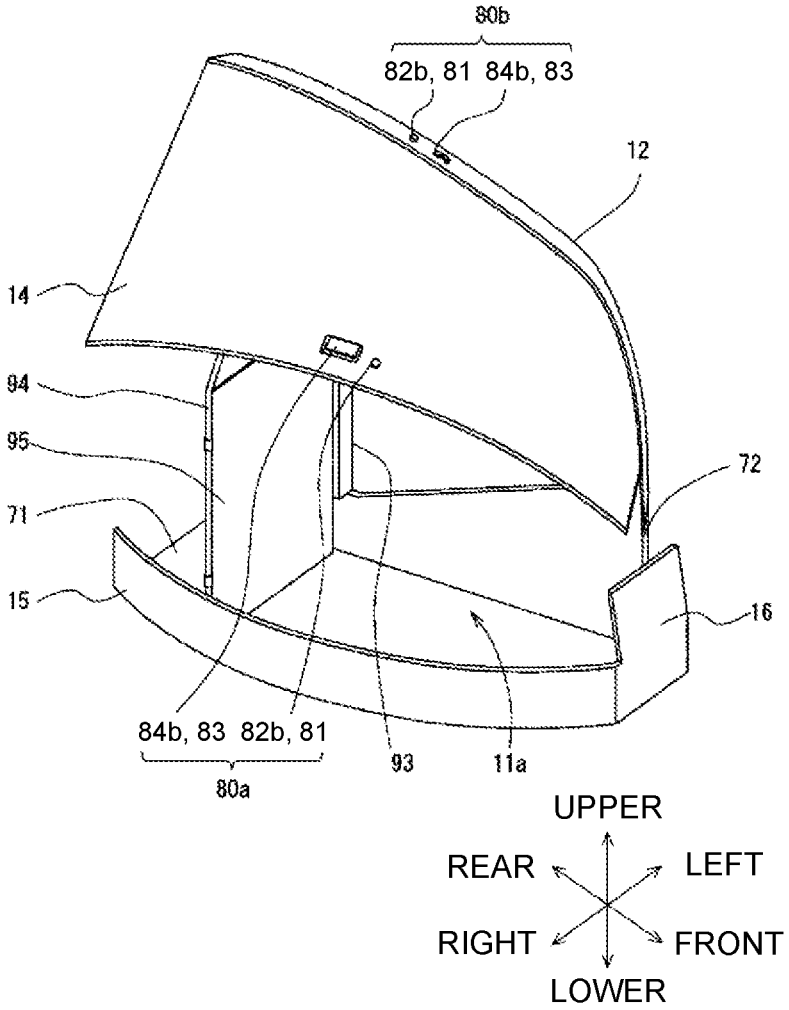
FIG. 6 is a perspective view of a state of opening, together with the upper face cover, a right exterior cover that covers the lateral-part engine chamber.

The exterior cover that covers the lateral-part engine chamber 11*a* of the swing frame 7 is to be described with reference to FIGS. 4 to 6. These figures show only the part on the right side of the swing frame 7, omitting the devices placed in the lateral-part engine chamber 11*a*.

In the lateral-part engine chamber 11*a*, as described with reference to FIG. 3, there are placed the fuel tank 51, the hydraulic oil tank 52, the battery 54, and the heat exchange unit 60. Of the exterior covers covering these configurations, the upper face cover 12 is so provided as to open and close by itself (see FIG. 5), and the right exterior cover 14 is so provided as to open and close together with the upper face cover 12 (see FIG. 6).

The upper face cover 12 has a substantially rectangular shape in plan view, with the right end edge in the form of an arc along the outline of the swing frame 7 and the left end edge being linear. The left end edge side of the upper face cover 12 is rotatably supported by a hinge mechanism 140 to be described below. The right exterior cover 14 has a substantially rectangular shape in side view, and has an arc shape in plan view along the outline of the swing frame 7. The upper end edge of the right exterior cover 14 is so formed as to fit to the right end edge of the upper face cover 12. That is, the right end edge as one end edge of the upper face cover 12 is supported to the right exterior cover 14 as a lateral face cover covering the engine chamber 11. Further, the lower end edge of the right exterior cover 14 is so formed as to fit to the right lower exterior cover 15, and is so configured as to be apart from and contact the right lower exterior cover 15.

Between the lower end edge of the right exterior cover 14 and the upper end edge of the right lower exterior cover 15, there is provided a right exterior cover lock mechanism 80*a*. The right exterior cover lock mechanism 80*a* fixes the right exterior cover 14 to the right lower exterior cover 15. Further, between the upper end edge of the right exterior cover 14 and the right side end edge of the upper face cover 12, there is provided an upper face cover lock mechanism 80*b*. The upper face cover lock mechanism 80*b* fixes the upper face cover 12 to the right lower exterior cover 15. The right exterior cover lock mechanism 80*a* and the upper face cover lock mechanism 80*b* are similar, and are referred to as a lock mechanism 80 when collectively referred to below.

The lock mechanism 80 includes a lock device 81 having a keyhole part 82 and an engagement device 83 having a handle 84. The lock device 81 is of a cylinder lock type, for example; inserting a key into the keyhole part 82 and turning the key engages a lock member, which is connected to a cylinder lock, with an engagement member and disengages the lock member from the engagement member, thereby to perform a switching between locked and unlocked states. The engagement device 83, by operating the handle 84, engages an engagement pawl, which is connected to the handle 84, with the engagement member and disengages the engagement pawl from the engagement member. In the case of the right exterior cover lock mechanism 80*a*, the engagement member is provided on the right lower exterior cover 15 side. Further, in the case of the upper face cover lock mechanism 80*b*, the engagement member is provided on the right exterior cover 14 side. With the above lock mechanism 80, operating the handle 84 when the lock device 81 is in the unlocked state can open the desired exterior cover. Further, the handle 84 may be a flap-type handle 84*a*, as in the right exterior cover lock mechanism or a lever-type handle 84*b*, as in the upper face cover lock mechanism 80*b*.

The maintenance engineer, by operating the handle 84*a* on the right exterior cover 14 side with the lock device 81 of the right exterior cover lock mechanism 80*a* unlocked, separates the right exterior cover 14 from the right lower exterior cover making it possible to integrally open the right exterior cover 14 and the upper face cover 12 by a rotary movement with the left end edge side of the upper face cover 12 as a pivot point. Further, the maintenance engineer, by operating the handle 84*b* on the upper face cover 12 side with the lock device 81 of the upper face cover lock mechanism 80*b* unlocked, separates the upper face cover 12 from the right exterior cover 14, making it possible to open only the upper face cover 12.

Figure 7:
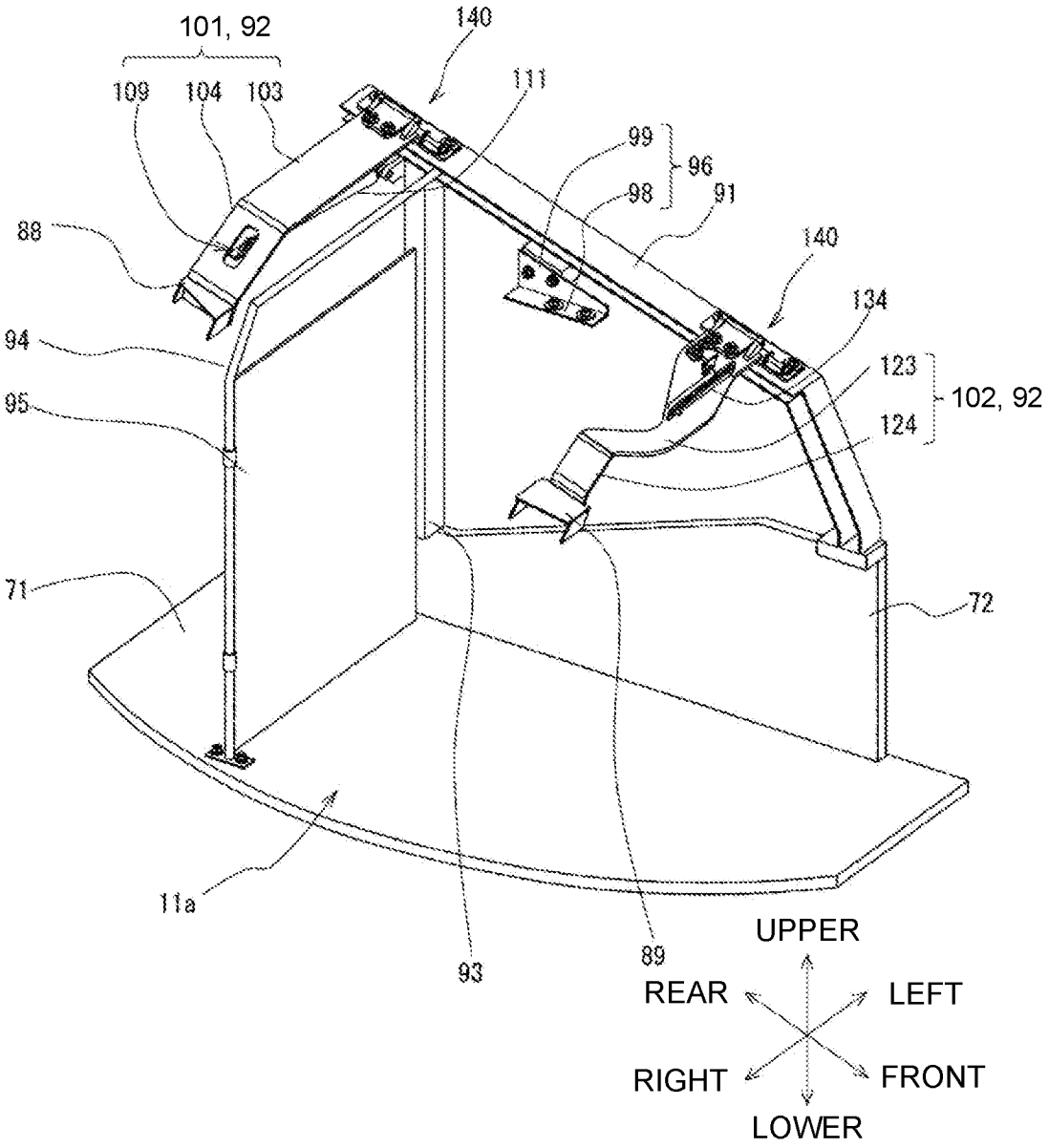
FIG. 7 is a perspective view illustrating a support structure of the exterior cover that covers the lateral-part engine chamber.
Figure 8:
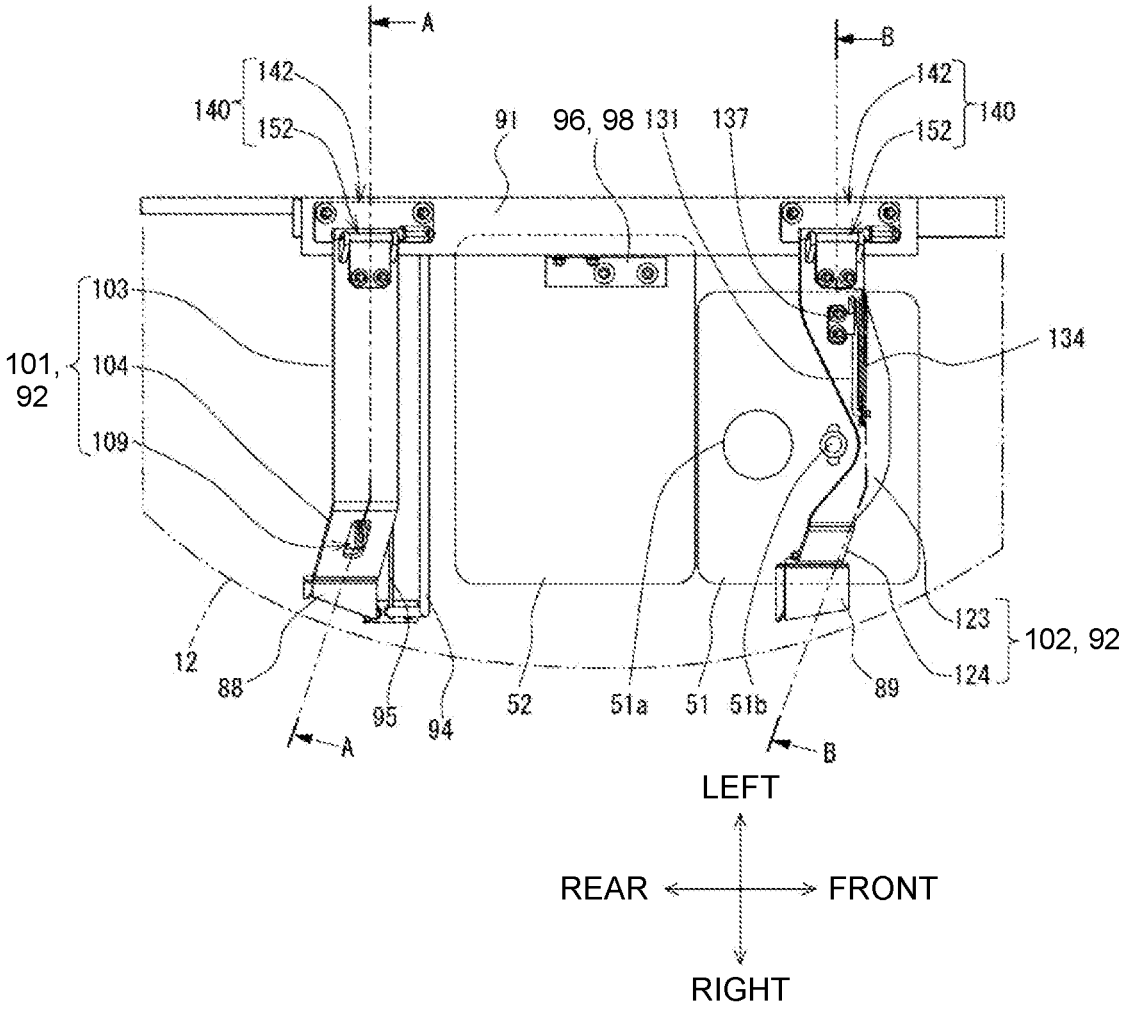
FIG. 8 is a plan view illustrating the support structure of the exterior cover that covers the lateral-part engine chamber.
Figure 9:
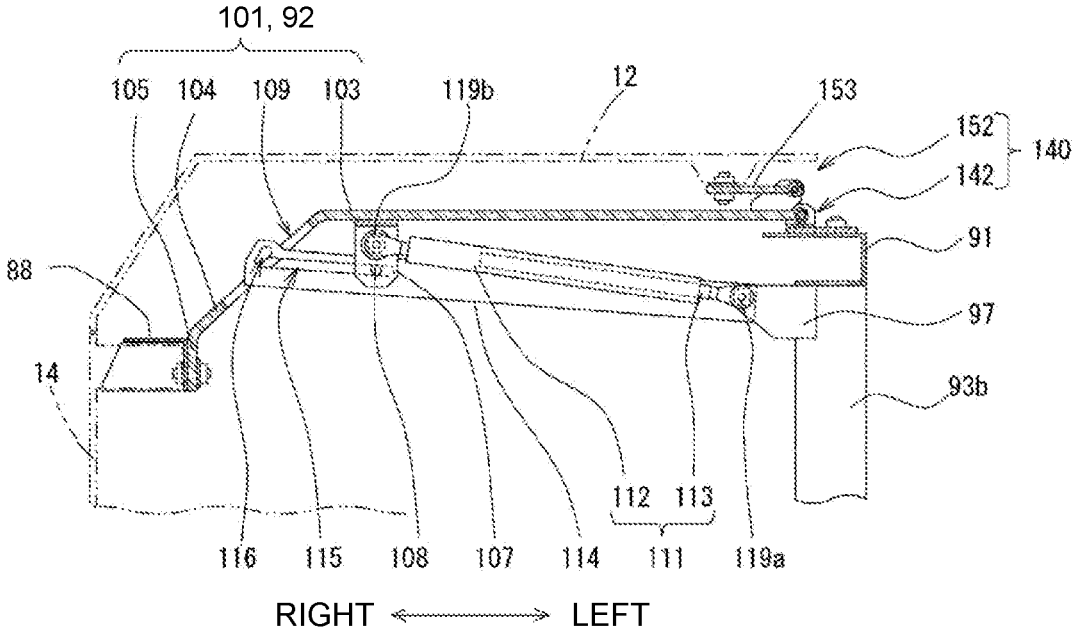
FIG. 9 is a cross-sectional overview illustrating a first link part in a state where the exterior cover that covers the lateral-part engine chamber is closed.
Figure 10:
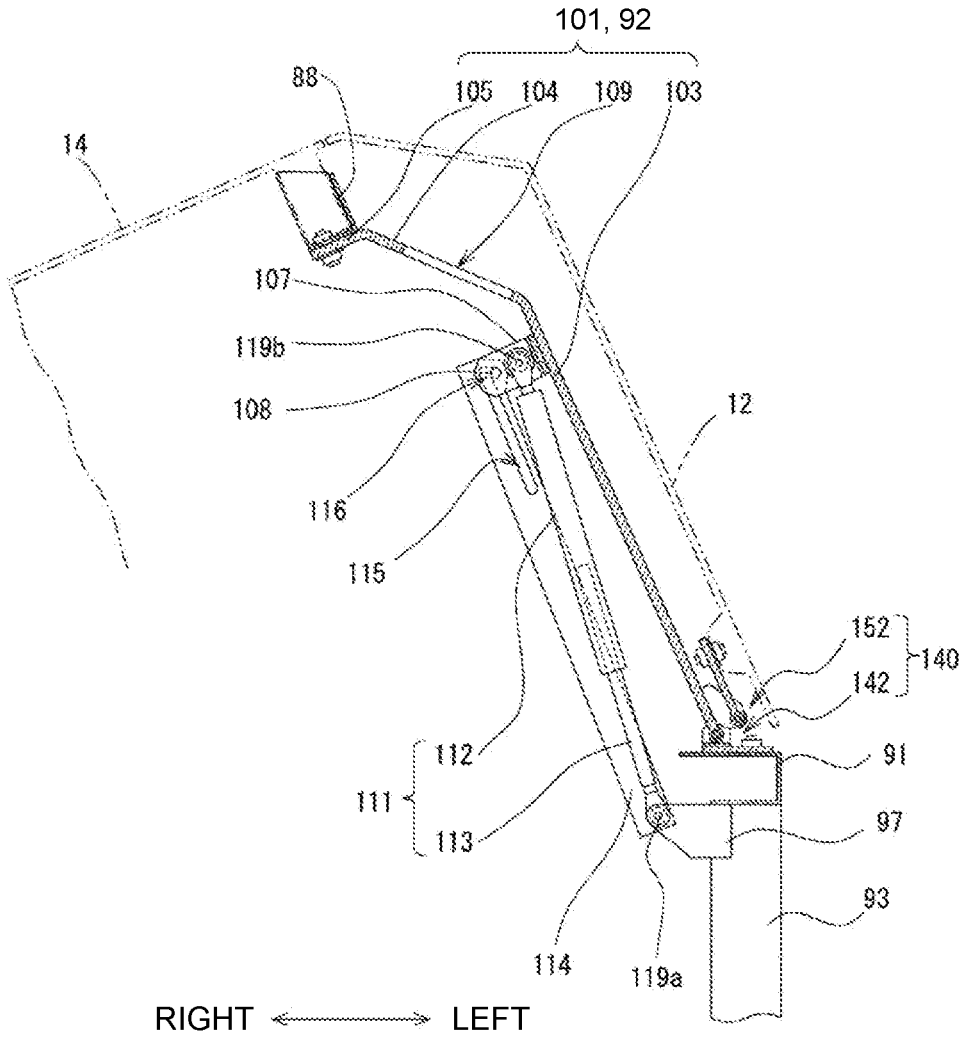
FIG. 10 is a cross-sectional overview illustrating a state where the first link part is turned thereby to open the exterior cover that covers the lateral-part engine chamber.
Figure 11:
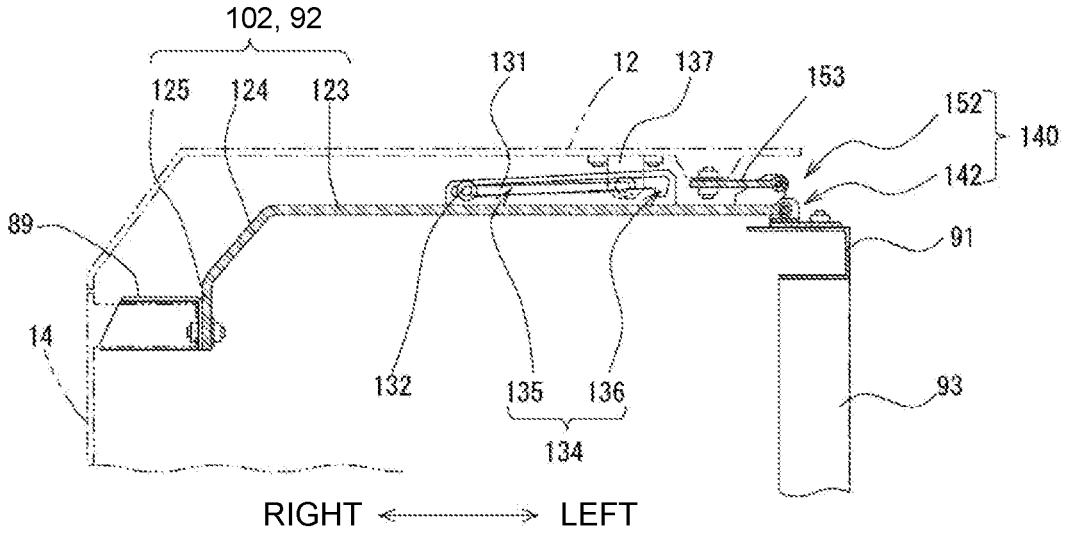
FIG. 11 is a cross-sectional overview illustrating a second link part in a state where the exterior cover that covers the lateral-part engine chamber is closed.
Figure 12:
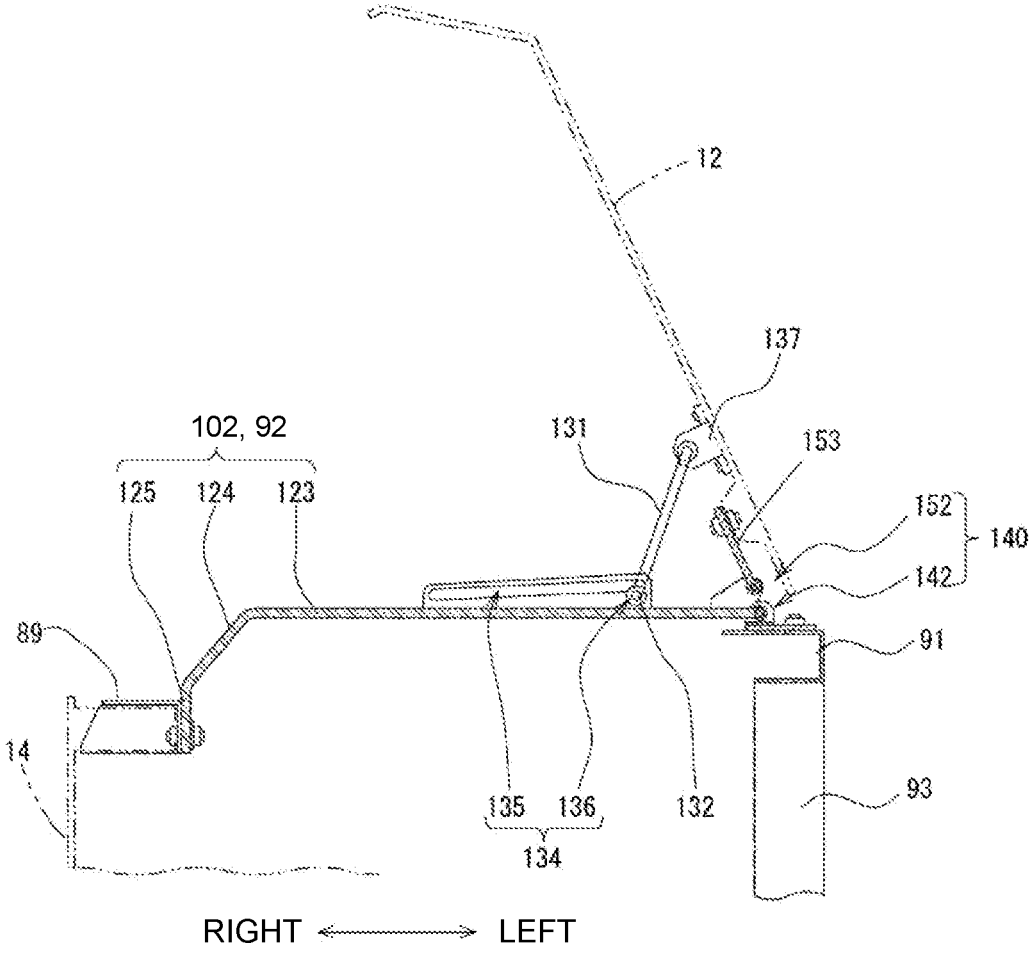
FIG. 12 is a cross-sectional overview illustrating a state where the second link part is turned thereby to open the upper face cover that covers above the lateral-part engine chamber.
Figure 13:
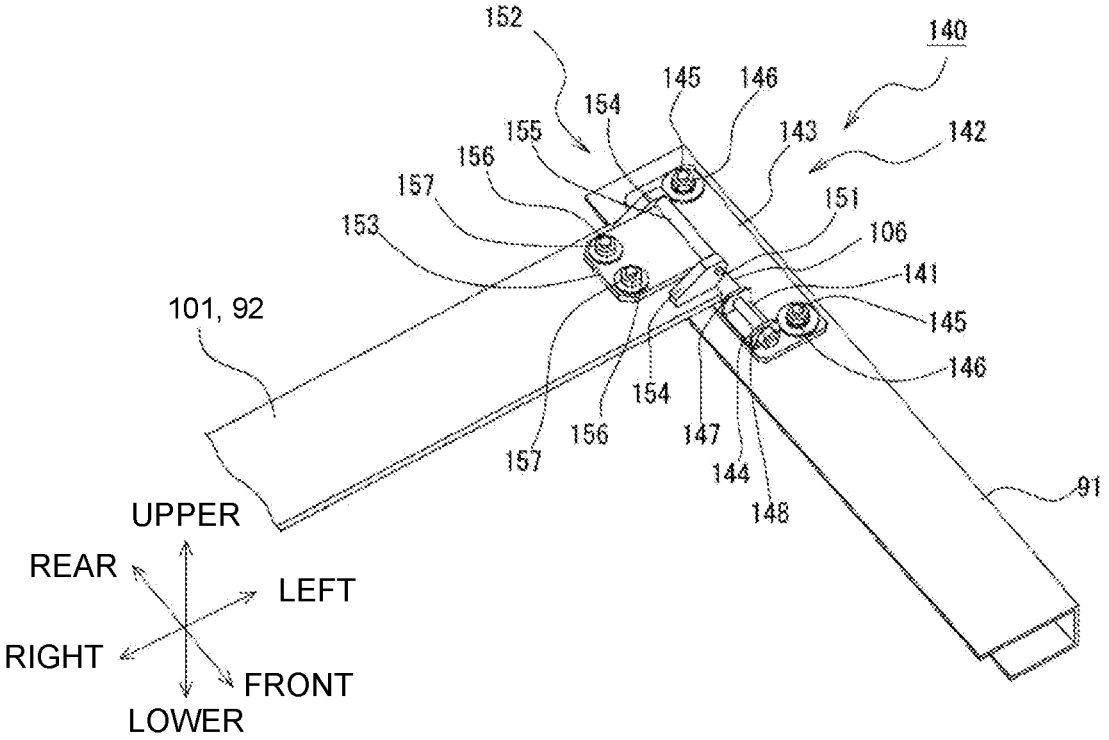
FIG. 13 is an enlarged perspective view illustrating a hinge mechanism.

The support structure and opening/closing structure of the exterior cover that covers the lateral-part engine chamber 11*a* on the right side of the swing frame 7 are to be described with reference to FIGS. 7 to 13. In FIGS. 7 and 8, the lateral-part engine chamber 11*a* is shown in a state where the upper face cover 12, the right exterior cover 14, and the right front cover 16 are removed. FIG. 9 shows the cross section A-A in FIG. 8, and FIG. 10 shows a state where a first link part 101 is rotated from the state shown in FIG. 9 thereby to open the upper face cover 12 and the right exterior cover 14. FIG. 11 shows the cross section B-B in FIG. 8, and FIG. 12 shows a state where a second link part 102 is rotated from the state in FIG. 11 thereby to open only the upper face cover 12. In FIGS. 9 to 12, the upper face cover 12 and the right exterior cover 14 are shown by two-dot chain lines. Further, FIG. 13 is an enlarged perspective view illustrating the hinge mechanism. Further, these figures omit the inner configuration of the lateral-part engine chamber 11*a*, for convenience of description.

The lateral-part engine chamber 11*a* has, as frame bodies that support the right exterior cover 14 and the upper face cover 12, a first frame part 91 and a second frame part 92 that connects the first frame part 91 with the right exterior cover 14.

The first frame part 91 is a beam part that is provided along the front-rear direction of the swing frame 7 in plan view, and supports the structure that encloses the upper part of the lateral-part engine chamber 11*a*. The first frame part 91 includes a steel material which has a substantially C-shaped cross section and is long in the front-back direction. The front side of the first frame part 91 bends downward at an obtuse angle, and is attached to the right longitudinal rib 72. The first frame part 91 is supported on its rear side by a main pillar 93. The lower end of the main pillar 93 is fixed to the upper end edge on the rear side of the right longitudinal rib 72. The first frame part 91 is so provided that the front part is lower relative to the rear part, with the height gradually decreasing toward the front. In the present embodiment, the front end of the first frame part 91 and the lower end of the main pillar 93 are fixed to the right longitudinal rib 72, but may be fixed directly to the substrate 71.

The first frame part 91 is supported on the right side thereof by an auxiliary pillar 94. The auxiliary pillar 94 is formed by bending a bar material at a substantially 90-degree angle. One end of the auxiliary pillar 94 is fixed to the lateral face of the first frame part 91, and the other end of the auxiliary pillar 94 is fixed to the substrate 71 by screw fastening.

Within the frame enclosed by the main pillar 93 and the auxiliary pillar 94, there is provided a partition plate 95 as a partition part that, in the lateral-part engine chamber 11*a*, partitions the area where tanks are placed and the area where devices such as the heat exchange unit 60 and battery are placed. The auxiliary pillar 94 and the partition plate 95 also function as support members that support the air cleaner 55 at a given height position, or as hold members for holding cables and the like that connect the battery 54 with the devices, for example. Further, the partition plate 95 does not have to cover the entire face in the frame enclosed by the main pillar 93 and auxiliary pillar 94, but may partially cover the above frame so that the lower part or upper part is open.

The upper part of the first frame part 91 is a flat face, and a pair of hinge mechanisms 140, described below, is provided at a given interval on this flat face.

On the lower side of the first frame part 91, there is provided a tank attaching part 96 to which the hydraulic oil tank 52 is attached. The tank attaching part 96 is a so-called L-shaped metal fitting, and has a tank connection part 98 which is provided parallel to the substrate 71 and includes a plate face, and a frame connection part 99 which is provided perpendicular to the substrate 71 and includes a plate face.

The tank connection part 98 is connected to the upper part of the hydraulic oil tank 52 by screw fastening, and the frame connection part 99 is fixed to the first frame part 91 by welding or screw fastening. Via the tank attaching part 96 configured above, the hydraulic oil tank 52 is fixed to the first frame part 91. Further, the hydraulic oil tank 52 includes a sheet metal, and the bottom side thereof is fixed to the substrate 71. The upper side of a liquid storage tank such as the hydraulic oil tank 52 placed on the substrate 71 can be fixed to the first frame part 91, thus making it possible to improve stability seen when placing the liquid storage tank on the swing frame 7. Further, the tank attaching part 96 is provided in the first frame part 91's middle position in the front-back direction, thus connecting that the first frame part 91 via the hydraulic oil tank 52 to the substrate 71. The first frame part 91 is supported from below by the hydraulic oil tank 52 and the tank attaching part 96, thus making it possible to increase rigidity of the first frame part 91.

The second frame part 92 has the first link part 101 placed on the rear side and the second link part 102 placed on the front side. The first link part 101 and the second link part 102 are provided from the first frame part 91 toward the right, and connect the right exterior cover 14 to the first frame part 91. That is, when the extension direction of the first frame part 91 is defined as the longitudinal direction in plan view, and the extension direction of the first link part 101 and second link part 102 of the second frame part 92 is defined as the transverse direction, the first frame part 91 and the second frame part 92 are in a positional relation substantially perpendicular. The left end part (base end part) of each of the first link part 101 and the second link part 102 is connected via the hinge mechanism 140 to the first frame part 91. The first link part 101 and the second link part 102 are pivotally supported at their left ends by a pair of hinge mechanisms 140 so provided on the first frame part 91 as to be spaced apart.

The first link part 101 is formed of a sheet metal with the up-down as the thickness direction and the front and back as the width direction. The first link part 101 includes a horizontal part 103, an inclined part 104, and a connection part 105. In the first link part 101, the connection part 105, which is provided at an angle of substantially 90 degrees to the horizontal part 103, is connected via the inclined part 104 to the right end side of the horizontal part 103, thereby to facilitate a connection to the inner wall of the right exterior cover 14.

Further, the connection part 105 is provided with an attaching part 88 that attaches the first link part 101 to the right exterior cover 14. The attaching part 88 is fixed to the connection part 105 by screw fastening. Via the attaching part 88, the first link part 101 is attached to a bracket protruding from the inner wall of the right exterior cover 14. Further, at the left end as the base end of the first link part 101 (left end of the horizontal part 103), there is provided a cylindrical boss part 106 through which a first pivot shaft 141 (see FIG. 13) of the hinge mechanism 140 is inserted.

On the underside of the first link part 101, there are provided a gas spring 111 and a stay plate part 114.

The gas spring 111 is provided with the right-left direction as the expansion-contraction direction. The gas spring 111 is a bias part that biases the rotation of the first link part 101; moving the rod 113 relative to the cylinder 112 using a reaction force of a high-pressure gas sealed in the cylinder 112 expands and contracts the gas spring 111. The gas spring 111's left end as the rod side is so supported to a rod-side bracket 97, which protrudes below the first frame part 91, as to be rotatable about a shaft 119*a*. The gas spring 111's right end as the cylinder side is so supported to a cylinder-side bracket 107, which protrudes downward on the lower side of the horizontal part of the first link part 101, as to be rotatable about a shaft 119*b*. The gas spring 111 extends when the right exterior cover 14 together with the upper face cover 12 is rotated in the open direction, and contracts when the right exterior cover 14 is rotated in the close direction. Further, instead of the gas spring 111, an oil cylinder with a viscous liquid such as a silicone oil sealed in the cylinder may be used.

The stay plate part 114 is a first hold part that holds the rotary angle of the first link part 101 at a given angle. The stay plate part 114, when the right exterior cover 14 together with the upper face cover 12 is opened, supports the upper face cover 12 and the right exterior cover 14, and also holds the gas spring 111 extended. The stay plate part 114, with the front-back direction as the thickness direction, is placed along the expansion-contraction direction of the gas spring 111. On the right side of the stay plate part 114, there is provided a long hole 115 into which a pin 108 provided on the cylinder-side bracket 107 is slidably inserted. The length of the long hole 115 corresponds to the extension-contraction length of the rod 113 of the gas spring 111. The right end of the long hole 115 is bent into a substantially V shape, forming a fit part 116 for fitting the pin 108. The left end of the stay plate part 114, like the gas spring 111, is so supported to the rod-side bracket 97 as to be rotatable about the shaft 119*b*. In the state of the right exterior cover 14 closed, the right upper end of the stay plate part 114 protrudes upward from a long hole 109 provided in the inclined part 104 of the first link part 101.

When the right exterior cover 14 together with the upper face cover 12 is rotated in the open direction, both the gas spring 111 and the stay plate part 114 are put in a state of being inclined at a given angle (e.g., 45 to 85 degrees) from the horizontal state with the shaft 119*b* of the rod-side bracket 97 as a pivot point. At this time, the pin 108 of the extended gas spring 111 fits into the fit part 116 of the stay plate part 114 causes the stay plate part 114 to support the loads of the right exterior cover 14 and upper face cover 12. The stay plate part 114 regulates the gas spring 111's contraction due to the dead weights of the right exterior cover 14 and upper face cover 12, keeping the lateral-part engine chamber 11*a* open.

The second link part 102 is formed of a sheet metal with the up-down as the thickness direction and the front and back as the width direction. The second link part 102, like the first link part 101, includes a horizontal part 123, an inclined part 124, and a connection part 125. Meanwhile, the second link part 102, unlike the first link part 101, has the horizontal part 123 curved toward the front side in plan view. On the lower side of the second link part 102, there is provided the fuel tank 51, as shown in FIG. 8. Due to this, the horizontal part 123 of the second link part 102 is bent in shape so as to secure, above the fuel tank 51, a work space for a fueling port 51*a* and a tank liquid level gauge attaching part 51*b*.

Further, the connection part 125 is provided with an attaching part 89 that attaches the second link part 102 to the right exterior cover 14. The attaching part 89 is fixed to the connection part 125 by screw fastening. The second link part 102 is attached via the attaching part 89 to a bracket so welded or otherwise as to protrude from the inner wall of the right exterior cover 14. The left end of the second link part 102 (left end of the horizontal part 123) is provided with a cylindrical boss part 126 through which the second pivot shaft 151 (see FIG. 13) of the hinge mechanism 140 is inserted.

On the upper face of the horizontal part 123, there is provided a guide part 134 which is placed with the front-back direction as the board thickness direction, and which is formed with a long hole 135 which is long in the right-left direction. The guide part 134 guides the stay 131 at the time of opening and closing the upper face cover 12. The stay 131 is for keeping, when the upper face cover 12 is rotated in the open direction, the upper face cover 12 open. The stay 131 is made of a round bar, one end of the stay 131 is bent forward at a substantially angle, and the tip of the one end is rotatably connected to a bracket 137 provided on the rear face of the upper face cover 12. Another end of the stay 131 is bent forward at a substantially 90-degree angle, and the tip of the other end is slidably inserted into the long hole 135 of the guide part 134. The left end of the long hole 135 is bent in a substantially inverted V shape, thereby to form a fit part 136 that fits a tip 132 of the stay 131. When the upper face cover 12 is rotated in the open direction by a given angle (e.g., 45 to 85 degrees), the right tip of the stay 131 fits into the fit part 136, thereby to keep the open state while supporting the load of the upper face cover 12 with the stay 131. The guide part 134 and the stay 131 are each a second hold part that holds the rotary angle of the upper face cover 12 at a given angle.

For closing the upper face cover 12 in the open state, the maintenance operator manually releases the fitting between the one end of the stay 131 and the fit part 136. The first frame part 91 is lower in height on the front side than on the rear side, and the second link part 102 is to be provided in a position lower than the first link part 101. The guide part 134 and stay 131 as the second hold parts are placed on the upper face of the horizontal part of the second link part 102, but are provided in a position lower than the first link part 101. That is, when the excavation work machine has a machine mass of, for example, 5 to 11 t (ton) as in the present embodiment, the second hold part can be provided at a height where the maintenance operator does not have to work on some kind of platform or crawler. This facilitates the maintenance worker's access to the stay 131.

Next, the hinge mechanism 140 is to be described. The hinge mechanism for the first link part 101 and the hinge mechanism for the second link part 102 are both the same. The hinge mechanism 140 for the first link part 101 is to be described here as an example.

As shown in FIG. 13, the hinge mechanism 140 has a first hinge part 142 by which the first link part 101 is rotatably supported to the first frame part 91, and a second hinge part 152 by which the upper face cover 12 is rotatably supported to the first frame part 91.

The first hinge part 142 has a fix plate part 143 that is attached to the first frame part 91 and a shaft support part 144 that supports the first pivot shaft 141. The fix plate part 143 has a substantially rectangular shape in plan view; hole parts for inserting bolts 145 are provided at two places that are symmetrical in the front-back direction. The bolts 145 inserted into the hole parts are fastened with nuts 146, thereby to secure the fix plate part 143 to the upper face of the first frame part 91. The shaft support part 144 supports both ends of the first pivot shaft 141 over the length of the long side of the rectangle of the fix plate part 143, and has a hole part through which the first pivot shaft 141 is inserted. In a position closer to the right side of the fix plate part 143, the shaft support part 144 are so provided at two places as to face each other in the front-back direction. The front and rear shaft support parts 144 are fixed to the fix plate part 143 by welding or the like.

Further, between the front and rear shaft support parts 144 and in a position spaced apart from one of the shaft support parts 144 by a distance that corresponds to the width of the first link part 101, there is provided a regulation part 147 that regulates the axial movement of the first link part 101. The regulation part 147 is the same in shape as the front and rear shaft support parts 144. The first pivot shaft 141 is supported to the front and rear shaft support parts 144 and the regulation part 147 with a substantially front-back direction as the rotary axis direction. Retaining members 148 are attached to both ends of the first pivot shaft 141 which is inserted through the boss part 106 of the first link part 101 and protrudes from the front and rear shaft support parts 144. This connects the first link part 101 via the first pivot shaft 141 to the first frame part 91.

The second hinge part 152 has a cover attaching part 153 to which the upper face cover 12 is attached and a shaft support part 154 that supports the second pivot shaft 151. The cover attaching part 153 has a substantially rectangular shape in plan view, and, at the left end which is the base end side, has a cylindrical boss part 155 provided with a hole part for inserting the second pivot shaft 151. Further, in symmetrical positions in the front-back direction on the left end side, the cover attaching part 153 is provided with hole parts for inserting bolts 156. The bolt 156 inserted into the hole part, via a connection part (not shown) on the back face of the upper face cover 12, is fastened to the nut 157. The shaft support part 154 has a hole part through which the second pivot shaft 151 is inserted, and, on the upper face of the horizontal part 103 adjacent to the boss part 106 of the first link part 101, is provided at two places spaced apart in the front-back direction by a distance equivalent to the width of the cover attaching part 153. The second pivot shaft 151 is supported to the front and rear shaft support parts 154 with the substantially front-rear directions as the rotary axis direction. The cover attaching part 153 is connected via the second pivot shaft 151 to the first link part 101. When the first link part 101 and the second link part 102 rotate, the cover attaching part 153 also rotates together about the second pivot shaft 151.

With the hinge mechanism 140 having the above configuration, the right exterior cover 14 together with the first link part 101 and the second link part 102 can rotate about the first pivot shaft 141. Turning the right exterior cover 14 upward pushes up the upper face cover 12, thus opening both the right exterior cover 14 and the upper face cover 12. This largely opens above and left side of the lateral-part engine chamber 11*a*. The upper face cover 12 together with the cover attaching part 153 is rotatable about the second pivot shaft 151. The upper face cover 12 by itself rotates upward thereby to open. This opens only above the lateral-part engine chamber 11*a*.

It can be said that the excavation work machine 1 according to the present embodiment provided with the above configuration has the following configuration. That is, the excavation work machine 1 has the vehicle body frame (swing frame 7), the engine chamber 11 that is provided on the vehicle body frame (swing frame 7) and that receives the prime mover and the devices, and a plurality of exterior covers that covers the engine chamber 11, wherein the excavation work machine 1 includes the first frame part 91 provided along the front-back direction (longitudinal direction) of the vehicle frame (swing frame 7) in plan view, and the second frame part 92 that is transversely provided from the first frame part 91, and that is connected at the base end thereof to the first frame part 91 and at the other end thereof to the lateral face cover (right exterior cover 14) which is of the exterior cover and which covers the lateral face of the engine chamber 11.

With the excavation work machine 1 according to the present embodiment provided with the above configuration, providing the engine chamber 11 with the structural frame having the first frame part 91 and the second frame part 92 supports the right exterior cover 14 by the first frame part 91 and the second frame part 92 and supports the upper face cover 12 by the first frame part 91. This means that, without the upper face cover 12 being detachably attached to the right exterior cover 14, each exterior cover is independently supported to the structural frame. Thus, depending on the placement of the devices of the engine chamber 11 and the nature of the maintenance work, the maintenance engineer, from the plural exterior covers, can choose to open only the upper face cover 12 or both the upper face cover 12 and the right exterior cover 14. For the user of the excavation work machine 1 to fuel the fuel tank, for example, the exterior cover (upper face cover 12) can be opened with the minimum necessary width limited to the upper face where the fueling port is positioned. This can reduce the foreign matter's entry into the engine chamber. Further, for the maintenance engineer to inspect the devices or replace the part, the exterior cover (right exterior cover 14 and upper face cover 12) can be opened at the maximum scale. Thus, the workability during maintenance is improved.

Further, in the above excavation work machine 1 according to the present embodiment, the second frame part 92 is rotatably supported via the first hinge part 142 to the first frame part 91. Further, the upper face cover 12 is rotatably supported via the second hinge part 152 to the first frame part 91.

With the excavation work machine 1 according to the present embodiment provided with the above configuration, the base end (left end) of the second frame part 92 is rotated by the hinge mechanism 140, which allows the maintenance engineer to easily open and close the right exterior cover 14 and the upper face cover 12 simultaneously.

Further, in the above excavation work machine 1 according to the present embodiment, the first hinge part 142 has the first pivot shaft 141 by which the base end of the second frame part 92 is pivotally supported, and the second hinge part 152 has the cover attaching part 153 that connects the upper face cover 12 and the second pivot shaft 151 by which the cover attaching part 153 is pivotally supported.

With the excavation work machine 1 according to the present embodiment provided with the above configuration, pivoting the base end of the second frame part 92 and the cover attaching part 153 on separate pivot shafts easily makes it possible to integrally open and close the right exterior cover 14 and the upper face cover 12 by simultaneously rotating the second frame part 92 and the cover attaching part 153 and to open and close only the upper face cover 12 by rotating only the cover attaching part 153. Thus, the exterior cover that covers the lateral-part engine chamber 11*a* has the opening/closing structure that opens and closes only the upper face cover 12 and integrally opens and closes the upper face cover 12 and the right exterior cover 14, thereby making it possible to improve workability during maintenance.

Further, in the above excavation work machine 1 according to the present embodiment, the second hinge part 152 is provided on the second frame part 92, thereby to provide, on the first frame part 91, the first hinge part 142 and the second hinge part 152 arranged in the up-down direction. This means that the first pivot shaft 141 and the second pivot shaft 151 are provided parallel to each other in the up-down direction.

With the excavation work machine 1 according to the present embodiment provided with the above configuration, the hinge mechanism 140, which includes two shafts, that is, the first pivot shaft 141 by which the right exterior cover 14 is rotatably supported and the second pivot shaft 151 by which the upper face cover 12 is rotatably supported, can be compactly configured.

Figure 14:
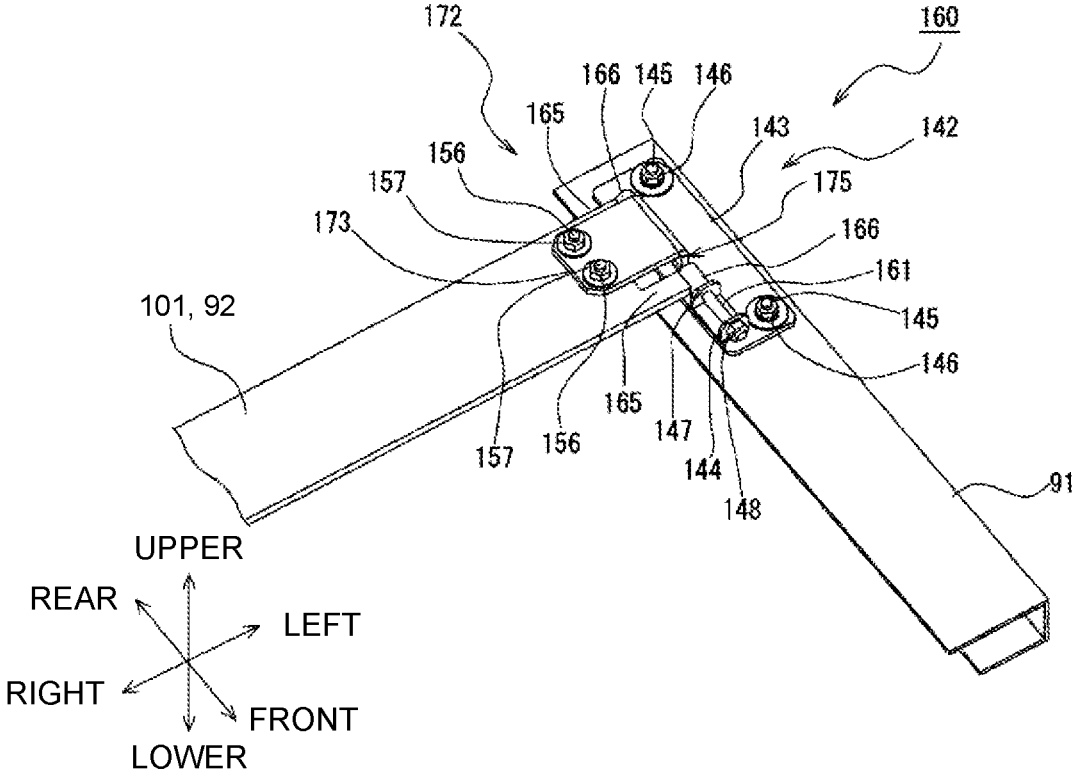
FIG. 14 is an enlarged perspective view illustrating a modified example of the hinge mechanism.

Modified examples of the hinge mechanism are to be described below. FIG. 14 illustrates a hinge mechanism 160 according to a modified example 1. The same symbol is to be used for a member similar to the counterpart of the hinge mechanism 140 described with reference to FIG. 13, and detailed description thereof is to be omitted. Further, likewise in the hinge mechanism 140, the hinge mechanism for the first link part and the hinge mechanism for the second link part are both the same, so the hinge mechanism 160 for the first link part is used as an example.

The hinge mechanism 160 according to the modified example 1 differs from the hinge mechanism 140 described above in that a pivot shaft which is of the first hinge part 142 and by which the first link part 101 is pivotally supported and a pivot shaft which is of a second hinge part 172 and by which a cover attaching part 173 is pivotally supported are configured as a single pivot shaft 161.

Further, a pair of arm parts 165 is formed on the left end side of the first link part 101, and a cylindrical boss part 166 having a hole part for inserting the pivot shaft 161 is provided at the tip of each of the arm parts 165. Further, the left end side of the second link part 102 is likewise deformed.

The second hinge part 172's cover attaching part 173 to which the upper face cover 12 is attached has a substantially L-shaped cross section, and a downward end part of the cover attaching part 173 is provided with a cylindrical boss part 175 having a hole part through which the pivot shaft 161 is inserted. The boss part 175 of the cover attaching part 173 is placed between the pairwise boss parts 166 of the first link part 101. Via the common pivot shaft 161, this connects the first link part 101 and the cover attaching part 173 to the first frame part 91. Rotating of the first link part 101 and the second link part 102 also rotates the cover attaching part 173 together about the pivot shaft 161.

The right exterior cover 14 together with the first link part 101 and the second link part 102 is rotatable about the pivot shaft 161. Rotating the right exterior cover 14 upward pushes up the upper face cover 12, thus opening both the right exterior cover 14 and the upper face cover 12. This largely opens above and left side of the lateral-part engine chamber 11*a*. The upper face cover 12, together with the cover attaching part 173, is rotatable about the pivot shaft 161, and only the upper face cover 12 rotates upward thereby to open. This opens only above the lateral-part engine chamber 11*a*.

In the above excavation work machine 1 according to the modified example 1, the shape of the left end of the first link part 101 and the shape of the left end of the cover attaching part 173 are so devised that the cover attaching part 173 is positioned on the first link part 101, thus providing the first hinge part 142 and the second hinge part 172 arranged in the up-down direction. This allows the hinge mechanism 160 to be configured compact. Further, using the single pivot shaft 161 for configuring the first and second pivot shafts simplifies the configuration of the hinge mechanism, making it possible to efficiently perform the assembly work.

Figure 15:
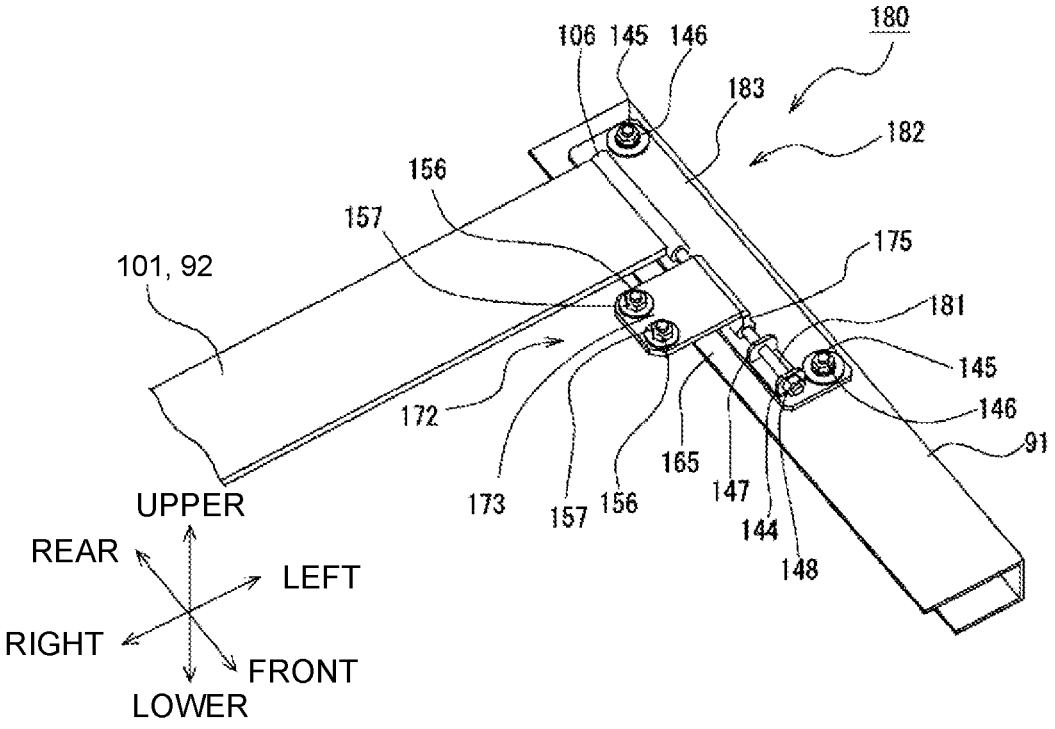
FIG. 15 is an enlarged perspective view illustrating another modified example of the hinge mechanism.

Another modified example of the hinge mechanism is to be described below. FIG. 15 illustrates the hinge mechanism 180 according to a modified example 2. The same symbol is to be used for a member similar to the counterpart of the hinge mechanism 140 described with reference to FIG. 13 and the counterpart of the hinge mechanism 160 according to the modified example 1, and detailed description thereof is to be omitted. Further, like in the hinge mechanism 140, the hinge mechanism for the first link part and the hinge mechanism for the second link part are both the same, so the hinge mechanism 180 for the first link part is used as an example.

In the hinge mechanism 180 according to the modified example 2, as in the modified example 1, the pivot shaft which is of a first hinge part 182 and by which the first link part 101 is pivotally supported and the pivot shaft which is of the second hinge part 172 and by which the cover attaching part 173 is pivotally supported are configured as a single pivot shaft 181. Further, the modified example 2 differs from the modified example 1 in that the boss part 106 of the first link part 101 and the boss part 175 of the cover attaching part 173, relative to a pivot shaft whose rotary axis direction is in the substantially front-back direction, are placed in parallel in the front-back direction. Thus, a fix plate part 183, to which the shaft support part 144 is fixed, and the pivot shaft 181 are longer in the front-back direction than the counterparts in the modified example 1.

The right exterior cover 14 is rotatable about the pivot shaft 181 together with the first link part 101 and the second link part 102. Rotating the right exterior cover 14 upward pushes up the upper face cover 12, thus opening both the right exterior cover 14 and the upper face cover 12. This largely opens above and left side of the lateral-part engine chamber 11*a*. The upper face cover 12 together with the cover attaching part 173 is rotatable about the pivot shaft 181, and only the upper face cover 12 rotates upward thereby to open. This opens only above the lateral-part engine chamber 11*a*.

The hinge mechanism 160 according to the modified example 1 and the hinge mechanism 180 according to the modified example 2 which are described above use the single pivot shafts 161, 181, respectively, but are not limited to this. That is, the pivot shaft by which the first link part 101 is pivotally supported and the pivot shaft by which the cover attaching part 173 is pivotally supported may be separate, and may be placed on the same axial line.

The above descriptions of the embodiment and modified examples are one example of the present invention, and the work machine according to the present invention is not limited to the above embodiment. Due to this, it is needless to say that, even to those other than the above embodiment, various changes can be made according to the design and the like within the scope that does not depart from the technical concept according to the present invention. Further, the effect described in the present disclosure is merely exemplary and is not limited, and another effect may also be exerted.

Further, the present invention may take the following modes.

APPENDIX 1

A work machine including:
- a vehicle body frame;
- an engine chamber that is provided on the vehicle body frame and that receives a prime mover and a device; and
- a plurality of exterior covers that covers the engine chamber, wherein the work machine includes:
- a first frame part that is provided along a front-back direction of the vehicle body frame in plan view, and
- a second frame part that is, at a base end thereof, connected to the first frame part and, at another end thereof, connected to a lateral face cover which is of the exterior covers and which covers a lateral face of the engine chamber.

APPENDIX 2

The work machine according to (appendix 1), wherein the second frame part is rotatably supported via a first hinge part to the first frame part.

APPENDIX 3

The work machine according to (appendix 2), wherein an upper face cover which is of the plurality of exterior covers and which covers an upper face of the engine chamber is rotatably supported via a second hinge part to the first frame part.

APPENDIX 4

The work machine according to (appendix 3), including:
- a first hinge part having a first pivot shaft by which a base end of the second frame part is pivotally supported, and
- a second hinge part having:
- a cover attaching part that connects the upper face cover, and
- a second pivot shaft by which the cover attaching part is pivotally supported.

APPENDIX 5

The work machine according to (appendix 4), wherein the first pivot shaft is provided in the first frame part, and the second pivot shaft is provided on a base end side of the second frame part.

APPENDIX 6

The work machine according to (appendix 4), wherein the first pivot shaft and the second pivot shaft are provided in the first frame part.

APPENDIX 7

The work machine according to (appendix 6), wherein the first pivot shaft and the second pivot shaft are provided on a same axial line.

APPENDIX 8

The work machine according to any of (appendix 2) to (appendix 7), wherein
- the second frame part has a first hold part that holds a rotary angle of the second frame part at a given angle.

APPENDIX 9

The work machine according to any of (appendix 3) to (appendix 7), wherein
- the second frame part has a second hold part that holds the rotary angle of the upper face cover at a given angle.

APPENDIX 10

The work machine according to any of (appendix 2) to (appendix 9), wherein
- the second frame part has a bias part that biases a rotation of the second frame part.

APPENDIX 11

The work machine according to any of (appendix 1) to (appendix 10), wherein
- the second frame part has a first link part and a second link part which are so placed on the first frame part as to be spaced apart from each other, and
- each of the first link part and the second link part connects the first frame part with the lateral face cover.

APPENDIX 12

The work machine according to any of (appendix 1) to (appendix 11), wherein
- the first frame part is connected via a pillar to the vehicle body frame.

APPENDIX 13

The work machine according to (appendix 12), wherein the pillar includes a first pillar and a second pillar, the first pillar has a linear shape and supports the first frame part from below, and the second pillar has a bent shape and supports the first frame part from side.

APPENDIX 14

The work machine according to (appendix 13), wherein between the first pillar and the second pillar, a partition part that partitions a space in the engine chamber is provided.

APPENDIX 15

The work machine according to (appendix 13) or (appendix 14), wherein the first frame part has one end that is formed by bending and the one end is connected to the vehicle body frame, and another end that is connected via the first pillar to the vehicle body frame.

APPENDIX 16

The work machine according to any of (appendix 1) to (appendix 15), wherein a storage tank capable of storing a liquid is placed in the engine chamber, and the first frame part has an attaching part to which the storage tank is attached.

APPENDIX 17

A work machine including: a swing frame; a cabin placed on a left side on the swing frame; and an engine chamber placed on a right side on the swing frame, wherein the work machine includes:

a right exterior cover that covers a right lateral face of the engine chamber, and an upper face cover that covers an upper part of the engine chamber, the upper face cover, above the right exterior cover, is so provided as to be rotatable with a left end edge side of the upper face cover as a pivot point, and the right exterior cover is so provided as to be rotatable integrally with the upper face cover with the left end edge side of the upper face cover as the pivot point.

APPENDIX 18

The work machine according to (appendix 17), wherein the engine chamber has a first frame part provided on the cabin side along a front-back direction and a second frame part that has a base end rotatably supported to the first frame part, and another end of the second frame part is attached to an inner wall of the right exterior cover.

APPENDIX 19

The work machine according to (appendix 18), wherein the upper face cover is rotatably provided at an upper part of the second frame part.

REFERENCE SIGNS LIST

1 excavation work machine (work machine)
2 travel vehicle body
5 travel part
7 swing frame (vehicle body frame)
11 engine chamber
12 upper face cover
14 right exterior cover (lateral face cover)
15 right lower exterior cover
51 fuel tank
52 hydraulic oil tank
53 engine (prime mover)
60 heat exchange unit (heat exchanger)
71 substrate
72 right longitudinal rib
80 lock mechanism
91 first frame part
92 second frame part
93 main pillar (first pillar)
94 auxiliary pillar (second pillar)
95 partition plate (partition part)
96 tank attaching part
101 first link part
102 second link part
111 gas spring (bias part)
114 stay plate (first hold part)
131 stay (second hold part)
140 hinge mechanism
160 hinge mechanism
180 hinge mechanism
142 first hinge part
152 second hinge part
172 second hinge part
182 first hinge part

The invention claimed is:

1. A work machine comprising:

a vehicle body frame;

an engine chamber that is provided on the vehicle body frame and that receives a prime mover and a device; and a plurality of exterior covers that cover the engine chamber, wherein the plurality of exterior covers include an upper face cover that covers an upper face of the engine chamber and a lateral face cover that covers a lateral face of the engine chamber, wherein the work machine includes:

a first frame part that is provided along a front-back direction of the vehicle body frame in plan view and rotatably supports the upper face cover, a second frame part that is, at a base end thereof, connected to the first frame part and, at another end thereof, connected to the lateral face cover.

2. The work machine according to claim 1, wherein the second frame part is rotatably supported by the first frame part.

3. The work machine according to claim 2, including:

a first hinge part having a first pivot shaft by which a base end of the second frame part is pivotally supported, and a second hinge part having:

a cover attaching part that connects the upper face cover, and a second pivot shaft by which the cover attaching part is pivotally supported.

4. The work machine according to claim 3, wherein the first pivot shaft is provided in the first frame part, and the second pivot shaft is provided on a base end side of the second frame part.

5. The work machine according to claim 3, wherein the first pivot shaft and the second pivot shaft are provided in the first frame part.

6. The work machine according to claim 5, wherein the first pivot shaft and the second pivot shaft are provided on a same axial line.

7. The work machine according to claim 2, wherein the second frame part has a first hold part that holds a rotary angle of the second frame part at a given angle.

8. The work machine according to claim 7, wherein the second frame part has a second hold part that holds a rotary angle of the upper face cover at a given angle.

9. The work machine according to claim 2, wherein the second frame part has a bias part that biases a rotation of the second frame part.

10. The work machine according to claim 1, wherein the second frame part has a first link part and a second link part which are so placed on the first frame part as to be spaced apart from each other, and each of the first link part and the second link part connects the first frame part with the lateral face cover.

11. The work machine according to claim 1, wherein the first frame part is connected via a pillar to the vehicle body frame.

12. The work machine according to claim 11, wherein the pillar includes a first pillar and a second pillar, the first pillar has a linear shape and supports the first frame part from below, and the second pillar has a bent shape and supports the first frame part from side.

13. The work machine according to claim 12, wherein between the first pillar and the second pillar, a partition part that partitions a space in the engine chamber is provided.

14. The work machine according to claim 13, wherein the first frame part has one end that is formed by bending and the one end is connected to the vehicle body frame, and has another end that is connected via the first pillar to the vehicle body frame.

15. The work machine according to claim 1, wherein a storage tank capable of storing a liquid is placed in the engine chamber, and the first frame part has an attaching part to which the storage tank is attached.

16. A work machine comprising:

a swing frame;

a cabin placed on a left side on the swing frame; and an engine chamber placed on a right side on the swing frame, wherein the work machine includes:

a right exterior cover that covers a right lateral face of the engine chamber, and an upper face cover that covers an upper part of the engine chamber, the upper face cover is so provided above the right exterior cover as to be rotatable with a left end edge side of the upper face cover as a pivot point, and the right exterior cover is so provided as to be rotatable integrally with the upper face cover with the left end edge side of the upper face cover as the pivot point.

17. The work machine according to claim 16, wherein the engine chamber has a first frame part provided on the cabin side along a front-back direction and a second frame part that has a base end rotatably supported to the first frame part, and another end of the second frame part is attached to an inner wall of the right exterior cover.

18. The work machine according to claim 17, wherein the upper face cover is rotatably provided at an upper part of the second frame part.

* * * * *